US009957144B2

(12) United States Patent
Clüsserath

(10) Patent No.: US 9,957,144 B2
(45) Date of Patent: May 1, 2018

(54) METHOD FOR CAPPING OR CLOSING CONTAINERS AND CAPPING OR CLOSING MACHINE

(75) Inventor: Ludwig Clüsserath, Bad Kreuznach (DE)

(73) Assignee: KHS GMBH, Dortmund (DE)

( * ) Notice: Subject to any disclaimer, the term of this patent is extended or adjusted under 35 U.S.C. 154(b) by 751 days.

(21) Appl. No.: 12/520,705

(22) PCT Filed: Nov. 8, 2007

(86) PCT No.: PCT/EP2007/009693

§ 371 (c)(1),
(2), (4) Date: Jun. 22, 2009

(87) PCT Pub. No.: WO2008/077446

PCT Pub. Date: Jul. 3, 2008

(65) Prior Publication Data

US 2010/0212260 A1 Aug. 26, 2010

Related U.S. Application Data

(63) Continuation-in-part of application No. PCT/EP2007/009693, filed on Nov. 8, 2007.

(30) Foreign Application Priority Data

Dec. 23, 2006 (DE) ..... 10 2006 061 498
Dec. 23, 2006 (DE) ..... 20 2006 019 465 U

(51) Int. Cl.

| | |
|---|---|
| ***B65B 31/02*** | (2006.01) |
| ***B67C 7/00*** | (2006.01) |
| ***B67B 3/00*** | (2006.01) |
| ***B67C 3/22*** | (2006.01) |

(52) U.S. Cl.
CPC ..... *B67C 7/0086* (2013.01); *B67B 3/00* (2013.01); *B67C 3/222* (2013.01); *B67C 7/0073* (2013.01)

(58) Field of Classification Search
CPC ..... B67C 7/0086; B67C 3/222; B67C 7/0073; B67B 3/00
USPC ..... 53/432, 431, 510, 283, 266.1, 269, 79, 53/287
See application file for complete search history.

(56) References Cited

U.S. PATENT DOCUMENTS

| | | | | |
|---|---|---|---|---|
| 2,876,787 | A * | 3/1959 | Gibson | 137/101.11 |
| 3,246,447 | A | 4/1966 | Smith et al. | |
| 3,477,192 | A * | 11/1969 | Brown et al. | 53/432 |
| 4,848,419 | A | 7/1989 | Damen | |

(Continued)

FOREIGN PATENT DOCUMENTS

| | | |
|---|---|---|
| CN | 1966390 A | 5/2007 |
| EP | 0 272 736 | 6/1988 |

(Continued)

OTHER PUBLICATIONS

Chinese Office Action 200780043173.

(Continued)

*Primary Examiner* — Sameh Tawfik
(74) *Attorney, Agent, or Firm* — Nils H. Ljungman & Associates

(57) ABSTRACT

This invention relates to a method and to a capping or closing machine for the capping or closing of bottles or similar containers filled with an oxygen-sensitive product.

18 Claims, 5 Drawing Sheets

(56) References Cited

U.S. PATENT DOCUMENTS

| | | | | |
|---|---|---|---|---|
| 5,271,207 | A * | 12/1993 | Epstein et al. | 53/432 |
| 5,896,727 | A * | 4/1999 | Egli et al. | 53/426 |
| 6,457,299 | B1 * | 10/2002 | Schwenke et al. | 53/510 |
| 7,536,839 | B2 * | 5/2009 | Kemper | A61L 2/22 53/309 |
| 7,685,796 | B2 | 3/2010 | Capelli et al. | |
| 7,866,123 | B2 * | 1/2011 | Clusserath | 53/202 |
| 2007/0237672 | A1 * | 10/2007 | Colato | A61L 2/087 422/28 |

FOREIGN PATENT DOCUMENTS

| | | |
|---|---|---|
| EP | 1 486 454 | 12/2004 |
| GB | 168588 | 2/1922 |
| GB | 2 174 682 | 11/1986 |
| WO | WO 94/25347 | 11/1994 |

OTHER PUBLICATIONS

International Search Report PCT/EP2007/009693 and English translation thereof.

International Preliminary Report on Patentability PCT/EP2007/009693 and English translation thereof.

* cited by examiner

METHOD FOR CAPPING OR CLOSING CONTAINERS AND CAPPING OR CLOSING MACHINE

This invention relates to a method for the closing or capping of bottles, cans or similar containers, in particular of containers that are filled with an oxygen-sensitive liquid, with a capping or closing machine under an inert gas atmosphere, and also relates to a capping machine for the capping or closing of bottles, cans or similar containers filled with a product or liquid, in particular with an oxygen-sensitive liquid, on their container mouths with the use of caps or closures under an inert gas atmosphere, with at least one capping or closing station with a capping or closing tool.

BACKGROUND OF THE INVENTION

A problem with many products, and with many beverages in particular, is that the shelf life and/or the quality, and in particular the taste, of products packaged in bottles or similar containers can be seriously and adversely affected by the inclusion of air or oxygen. The intrusion or inclusion of oxygen thereby occurs in particular during or after and product is filled into the bottle and/or during the capping or closing, e.g. via the open mouth of the container.

To remedy this problem, it is conventional with carbonated products such as beer, for example, to effect a controlled foaming of the product that is introduced into the respective container (e.g. bottle or can), and specifically by the injection of a foaming medium such as, for example, sterile water or a small amount of the product being bottled, to thereby use the foam that is formed above the surface of the product or liquid in the respective container to displace any air or oxygen that is present before the respective container is then closed or capped. One of several disadvantages with this method is that the foaming can result in significant product losses, and it is also necessary to control the foaming process so that an overfoaming or overflow of the product and thus a contamination of the external surface of the container can be prevented.

Object of the Invention

The object of the invention is a method and a capping or closing machine which prevents, respectively, an inclusion of oxygen in filled and closed containers that could adversely affect the shelf life and/or quality, in particular of oxygen-sensitive products, as well as the foaming of the respective product or liquid.

BRIEF SUMMARY OF THE INVENTION

To accomplish this object, the invention teaches a method for the closing or capping of bottles, cans or similar containers, in particular of containers that are filled with an oxygen-sensitive liquid, with a capping or closing machine under an inert gas atmosphere. The closing or capping of the containers takes place in an inert gas chamber or sub-chamber that contains the inert gas atmosphere formed by the closing or calling machine, in which the containers are held during the closing or capping at least in the vicinity of their container mouth. A capping or closing machine (capper) is the object of a capping machine for the capping or closing of bottles, cans or similar containers filled with a product or liquid, in particular with an oxygen-sensitive liquid, on their container mouths with the use of caps or closures under an inert gas atmosphere. The capping or closing machine comprises at least one capping or closing station with a capping or closing tool. The capping or closing machine also comprises at least one inert gas chamber or sub-chamber that is realized on the capping or closing machine and can be pressurized with the inert gas, in which the individual container to be capped or closed is contained during the capping or closing at least with an area that has the container mouth.

The invention achieves at least a significant reduction of the oxygen inclusion in containers filled with a liquid and capped or closed so that a long shelf life is achieved with no reduction in quality, even with oxygen-sensitive products. Overfoaming losses of the type that were unavoidable during the displacement of air or oxygen by foaming are also prevented.

The use of the invention also makes it possible to omit the extremely cost-intensive and problem-plagued high pressure injection systems of the prior art that are used to foam the liquid being bottled.

In the invention, the inert gas atmosphere is contained in an inert gas chamber or a sub-chamber of an inert gas chamber, which (inert gas chamber or sub-chamber) is formed by or on the capping or closing machine, for example by a housing of the capping or closing machine. This realization guarantees that the space to be supplied with the inert gas and containing the inert gas atmosphere has the smallest possible volume.

In one embodiment of the invention, the containers are each completely enclosed in the inert gas chamber or sub-chamber, i.e. over their full container height, during the capping or closing, whereby the height of the inert gas chamber or sub-chamber then equals essentially only the height of the containers.

In an additional preferred embodiment of the invention, the containers are each contained in the inert gas chamber or sub-chamber during the capping or closing only with the mouth area that has their container mouth, i.e. over a portion of their height that contains the container mouth, so that a particularly small volume is achieved for the space to be supplied with the inert gas.

BRIEF DESCRIPTION OF THE DRAWINGS

Developments of the invention are the object of the dependent claims. The invention is explained below in greater detail on the basis of the figures which show one exemplary embodiment, in which:

DETAILED DESCRIPTION OF THE DRAWINGS

Figure 1:
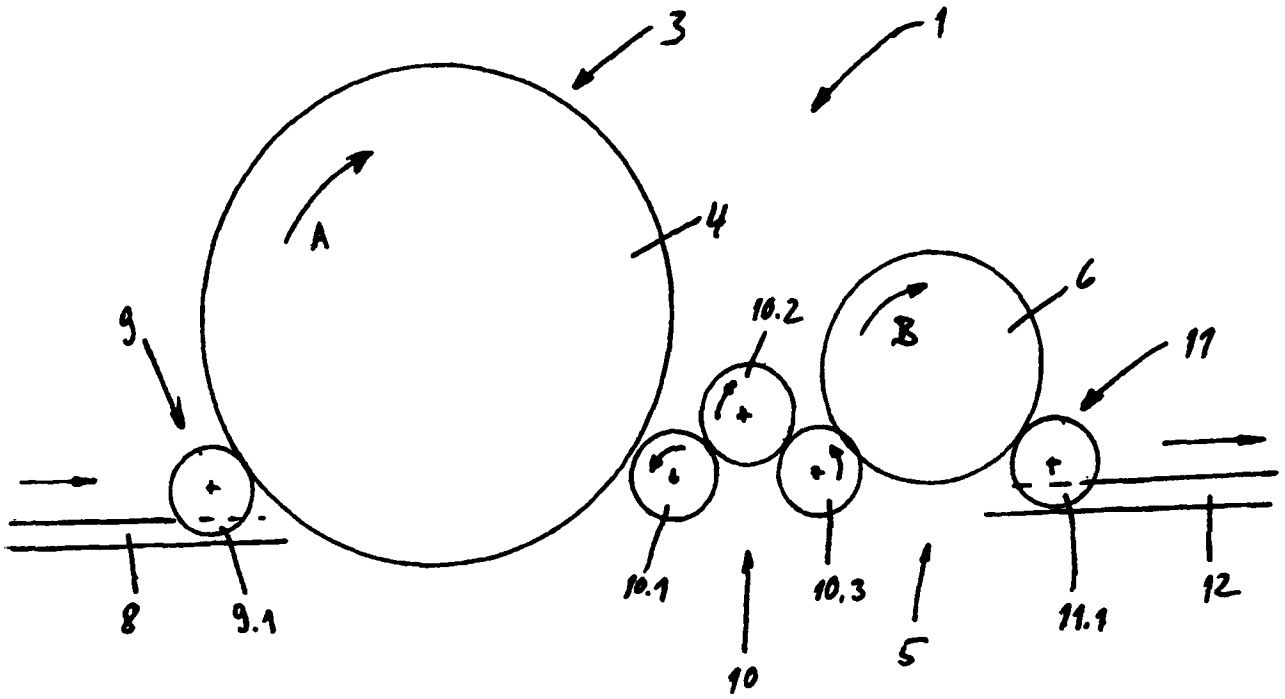
FIG. 1 is a schematic illustration of a plant for the filling of bottles or similar containers with a liquid and for the capping or closing of the containers in an inert gas atmosphere.
Figure 2:
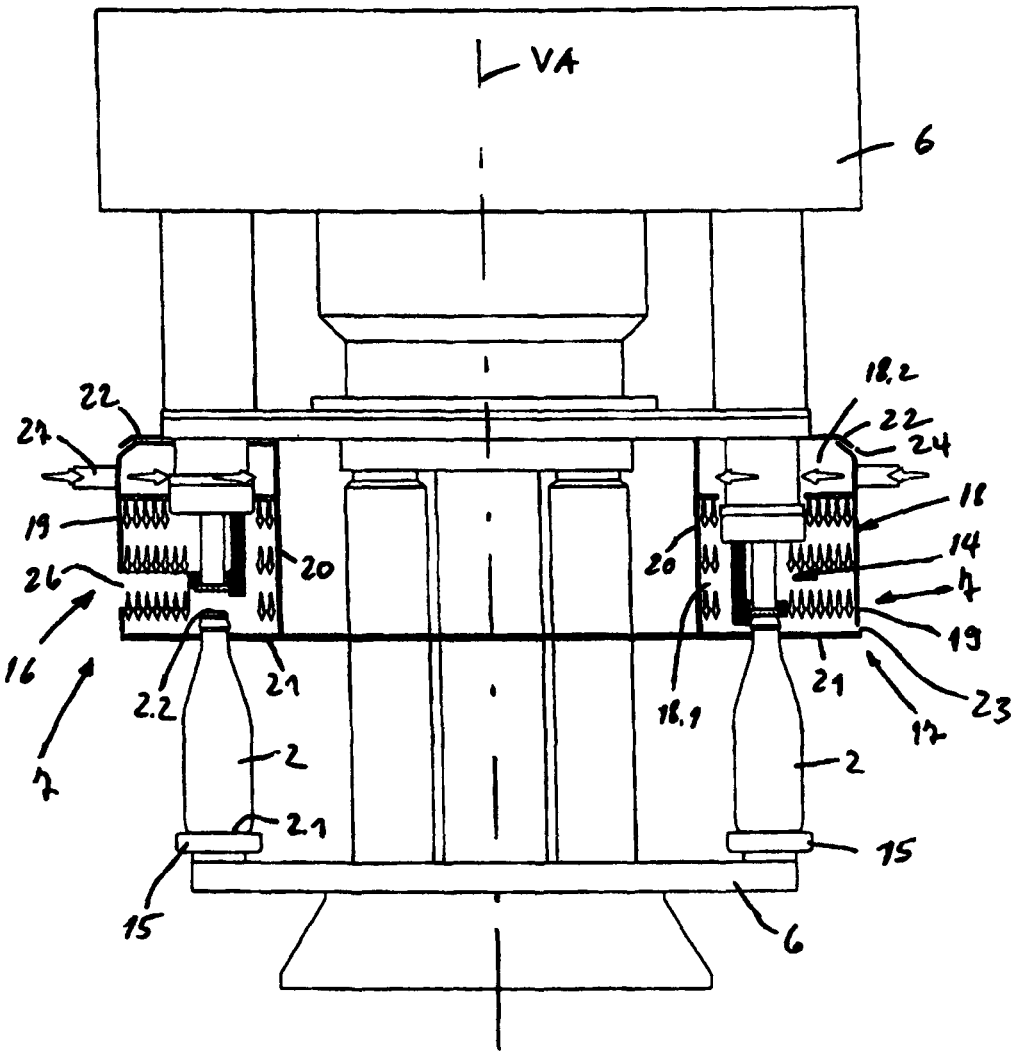
FIG. 2 is a simplified illustration of a capping or closing machine of the plant illustrated in FIG. 1.

The plant which is designated 1 in general in the figures is used for the filling of containers which are realized in the form of bottles 2 in the embodiment illustrated in FIG. 2 with a liquid product, e.g. with a beverage, and for the capping of the bottles 2 after the filling.

For this purpose, the plant 1 includes a filling machine 3 which has, for example, the conventional configuration that will be familiar to a technician skilled in the art with a rotor 4 (arrow A) which is driven in rotation around a vertical machine axis, and with a plurality of filling positions realized on the perimeter of the rotor 4, as well as a capping or closing machine 5 which also employs a rotary construction, i.e. with a rotor 6 which is driven in rotation (arrow B) around a vertical machine axis VA, with a plurality of capping positions 7 (e.g. FIG. 2) formed on the perimeter of the latter rotor 6.

The bottles 2 are delivered to the filling machine 3 in an upright position, i.e. with their bottle axis oriented in a vertical direction, by means of a conveyor 8 to the container or bottle inlet 9 formed by a transport or inlet star wheel 9.1. The filled and capped or closed bottles 2 travel via a transport line 10 which is formed by a plurality of transport star wheels 10.1-10.3 to one of the capping or closing positions 7 of the capping machine 5 and after the capping or closing are transported further by means of a transport or outlet star wheel 11.1 that forms the container outlet 11 to the conveyor 12 to be transported away. The capping or closing positions are distributed around the perimeter of the rotor 6 in equal angular intervals around the vertical machine axis VA of the capping machine 5.

In the unit 1, in which the filling machine 3 and the capping or closing machine 5 can also be combined into a block, the bottles 2 are capped or closed with caps or closures 13 which are illustrated in the form of crown corks, although they can also be realized in other forms. For this purpose, each capping or closing position 7 consists of a capping or closing tool 14 and a container or bottle carrier 15 which is provided below the associated capping or closing tool 14 and in the illustrated embodiment is realized in the form of a bottle plate on which the individual bottle 2 stands upright during the capping with its base 2.1.

The capping or closing positions 7 and their capping or closing tools 14 are realized in a manner that will be familiar to a technician skilled in the art so that as the rotor 6 rotates around the axis VA, they each receive a cap 13 in a cap delivery position 16 (FIG. 2). This cap 13 is then placed on the container or bottle mouth 2.2 of the respective bottle in an angular portion of the rotational movement of the rotor 6 that is adjacent to the position 16, and is fixed in position on this mouth by pressing with a stamp 14.1 and by deformation with a capping cone 14.3, as illustrated by 17 on the right in FIG. 2.

The special characteristic of the capping or closing machine 5 is that the capping or closing of the bottles 2 with the caps 13 takes place in an inert gas atmosphere, i.e. the capping tools 14, i.e. their functional elements that interact with the caps 13 and bottles 2, namely in the illustrated embodiment their stamps 14' and capping cones 14", are located in an inert gas chamber 18 through which there is a constant flow of inert gas, and the atmosphere of which has an at least sharply reduced percentage of oxygen. During the capping or closing process, the bottles 2 with their mouth area that has the bottle mouth 2.2 extend into this inert gas chamber 18 or in a sub-chamber 18.1 of this inert gas chamber 18. In the illustrated embodiment, the inert gas chamber 18 is realized in the form of an annular chamber that concentrically encircles the axis VA, and specifically, for example, is bounded by a plurality of wall elements, namely by an outer wall element 19 in the shape of a circular cylinder which concentrically encircles the axis VA, by an inner wall element 20 which is also in the shape of a circular cylinder and concentrically encircles the axis VA, by a bottom circular cylindrical wall element 21 which is oriented in a plane perpendicular to the axis VA and which concentrically encircles this axis and by a top circular ring-shaped wall element 22 which encircles the axis VA.

With the exception of the wall element 19, the wall elements 20-22 are provided on the rotor 6, and specifically so that the wall element 21 extends externally horizontally to the bottom edge of the wall element 19 and closes the inert gas chamber 18 at that point except for a gap 24 which remains between the wall elements 19 and 21. The diameter of the wall elements 19 and 20 is selected so that the wall element 19 is farther from the axis VA than the capping tools 5, and is at a sufficient radial distance from the latter. The diameter of the wall element 30 that concentrically encircles the wall element 19 is selected so that the wall element 20 lies closer to the axis VA than the capping tools 5 and is at a sufficient radial distance from the latter.

In the bottom wall element 21, at each capping or closing position 7, or closing process an opening 25 is provided, through which the individual bottle 2 extends during the capping or closing from below with its mouth area that has the bottle mouth 2.2, and into the bottom sub-chamber 18.1 of the inert gas chamber 18. To make this possible, the container carriers 15 can be raised and lowered in a controlled manner in an axial direction parallel to the axis VA, e.g. by lifting devices which are not shown. After the transfer or each bottle 2 to a capping or closing position 7, the initially lowered container carrier 15 is raised for the capping or closing process and the bottles 2 in question is thereby moved with its mouth area through the opening 25 into the sub-chamber 18.1. After the capping or closing, the bottle 2 in question is lowered again with the respective container carrier 15, so that the bottle 2 is completely outside the inert gas chamber 18.

Also conceivable and within the scope of the invention are configurations in which lifting devices are omitted. In a device of this type, the wall element 21 is realized, for example, in the form of a flat disc with receptacle pockets for the container neck located on its edge. The containers are pushed into these receptacle pockets without any change in their local height by suitable pusher means. The open outer edges of the pockets are closed, for example, by a non-rotating element, as a result of which the consumption of sterile air can be kept low.

At the point where the caps or closures 13 in the cap or closure receiving position are transferred to the capping tools 14 that are moving past this position, the external wall element 19 is provided with an opening 26.

Figure 3:
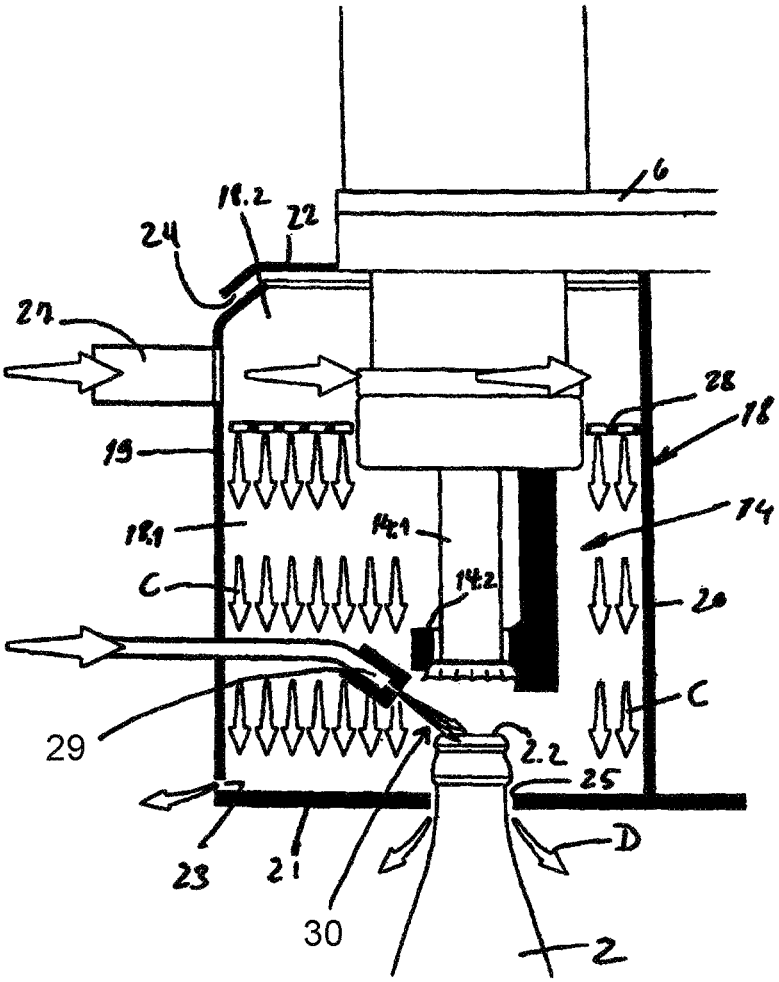
FIGS. 3 and 4 each show, in the form of enlarged details, various positions of the capping or closing machine illustrated in FIG. 2.
Figure 4:
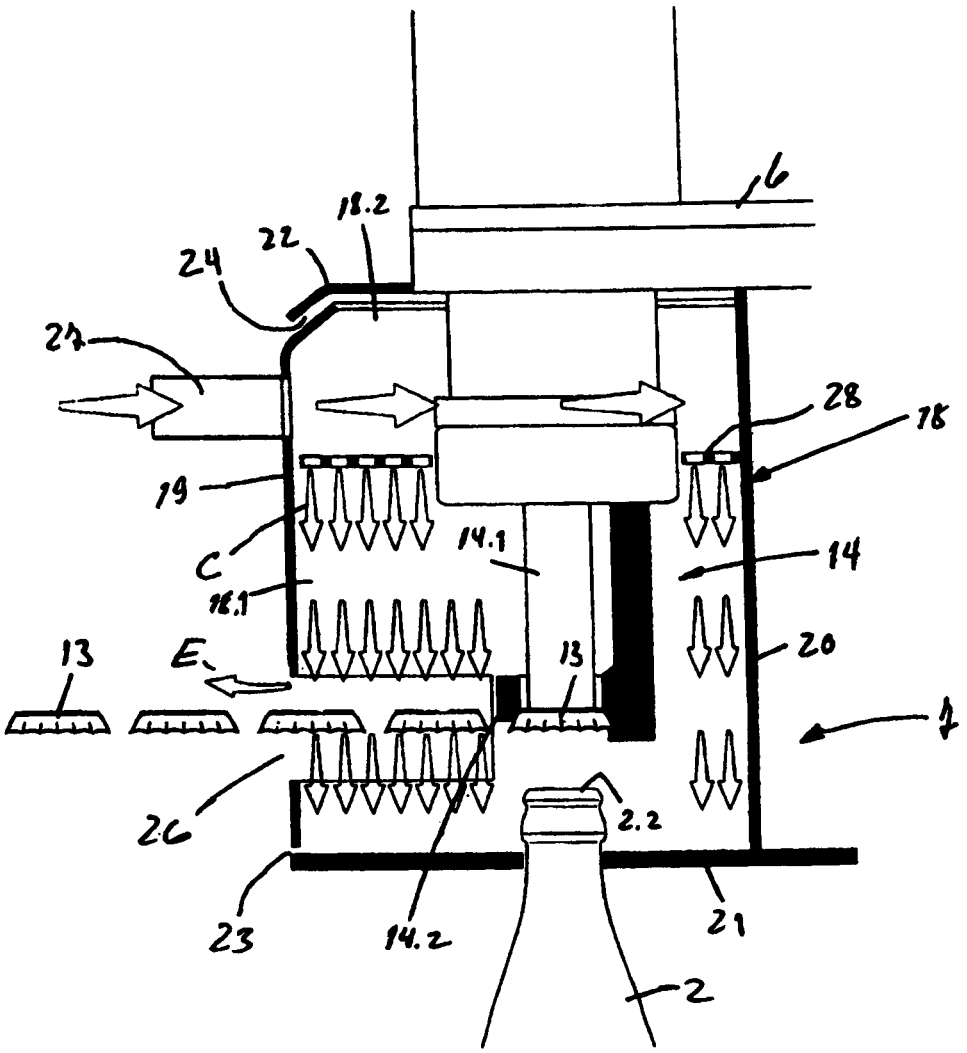

For the delivery of the inert gas, connections 27 are distributed around the axis VA in the upper portion of the wall element 19. The connections 27 each emerge in an upper sub-chamber 18.2 of the inner chamber 18. There is a perforated partition 28 between the two sub-chambers 18.1 and 18.2. In the illustrated embodiment this partition is also realized in the form of a circular ring and is oriented in a plane perpendicular to the axis VA. By means of the perforated partition 28 (perforated plate or laminator), a uniformly distributed or essentially uniformly laminar flow of the inert gas in the vertical direction from top to bottom is achieved in the sub-chamber 18.1, i.e. with a flow direction toward the bottle mouths 2.2, as indicated by the arrows C in FIGS. 2-4.

In the illustrated embodiment, on the wall element 19, in the direction of rotation B of the rotor 6, after the position in which the caps or closures 13 are transferred to the capping tools 14, there is at least one nozzle 29 past which the bottles 2 are moved with their bottle mouths 2.2. By means of the nozzle 29, each bottle 2 is sprayed with a jet 30 of inert gas in the interior of the bottle above the liquid level or in the space that is not occupied by the liquid being bottled (injection of inert gas), so that any residual air and oxygen in the respective bottle 2 can be removed.

The inert gas which is injected via the connections 27 and the nozzle 29 exits the inert gas chamber 18 or the sub-chamber 18.1 at openings which are formed in the lower area of the sub-chamber 18.1 not only by the gap 23 but in particular also by the respective annular gap between the edge of the openings 25 and the mouth areas of the bottles 2 and by the opening 26, so that the bottles 2 in their mouth area, the capping tools 14 and the caps 3 on the capping tools 14 are intensively flushed by the flow of inert gas, and the entry of oxygen into the bottles 2 which is harmful to the product or liquid is thereby effectively prevented with a low consumption of inert gas.

Especially as a result of the use of the nozzles 29 it is possible to prevent the entry of oxygen which has an adverse effect on the quality and/or shelf life of the product into the liquid, although the filling of the bottles 2 as well as the transport of the filled bottles 2 via the transport line 10 to the capping or closing machine 5 takes place under a normal atmosphere, for example, and only the capping of the bottles 2 is performed in the inert gas atmosphere, to ensure among other things the lowest possible consumption of inert gas. An additional factor in the reduction of the consumption of the inert gas is the fact that during the capping or closing the bottles 2 extend into the inert gas chamber 18 or into the sub-chamber 18.1 only with their mouth area, i.e. the inert gas area 18 has a reduced height in comparison to the height of the bottle and can therefore be realized with a relatively small volume.

Suitable gases for the inert gas atmosphere and/or for the inert gas injection are, for example, $CO_2$ or $CO_2$ gas and/or nitrogen.

Figure 5:
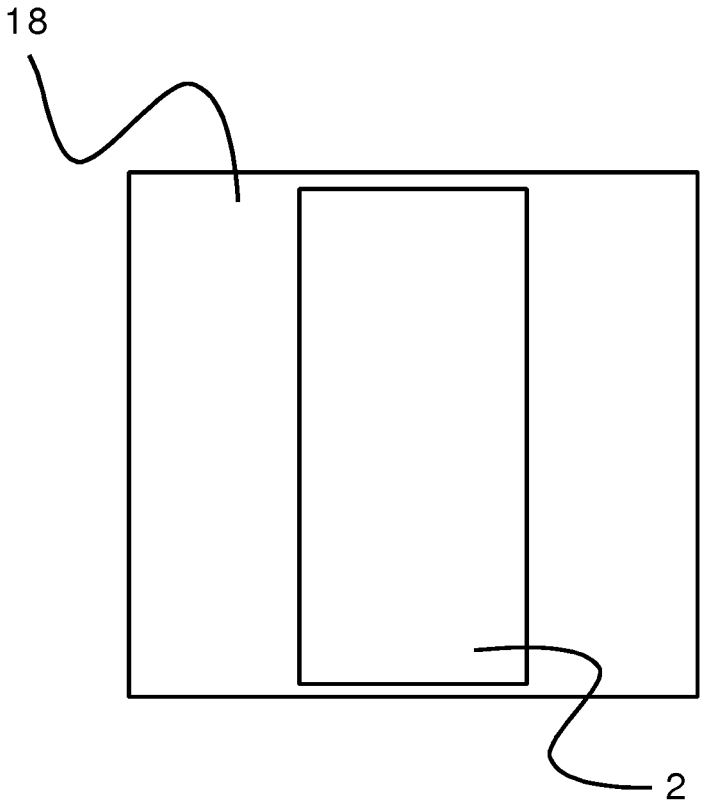
FIG. 5 shows a box drawing of an embodiment of the invention.

FIG. 5 shows a box drawing showing the entire bottle 2 disposed within the inert gas chamber 18.

The invention was described above on the basis of one exemplary embodiment. It goes without saying that numerous modifications and variations of the invention are possible without thereby going beyond the teaching of the invention.

For example, the invention is of course not limited to the use of closures 13 in the form of crown corks, but also includes the use of other types of closures and other capping or closing machines adapted to other types of closures.

LIST OF REFERENCE NUMBERS

1 Plant
2 Bottle
2.1 Bottle bottom
2.2 Bottle mouth
3 Filling machine
4 Rotor of the filling machine 3
5 Capping machine
6 Rotor of the capping machine 5
7 Capping position
8 Conveyor for the supply of empty bottles 2
9 Bottle or container inlet
9.1 Inlet or transport star wheel
10 Transport line
10.1, 10.2, 10.3 Transport star wheel
11 Bottle or container outlet
11.1 Outlet or transport star wheel
12 Conveyor
13 Cap or closure
14 Capping tool
14.1 Stamp
14.2 Capping cone
15 Container or bottle carrier
16 Transfer position for caps or closures 13
17 Position
18 Inert gas chamber
18.1, 18.2 Sub-chamber
19-22 Wall element
23, 24 Gap
25, 26 Opening
27 Connection for the introduction of the inert gas
28 Perforated partition
29 Nozzle
30 Nozzle jet
A Direction of rotation of the rotor 4
B Direction of rotation of the rotor 6
C Laminar flow of the inert gas
D Exit of inert gas to the openings 25
E Exit of inert gas to the openings 26

The invention claimed is:

1. A method of closing or capping containers comprising bottles, cans or similar containers containing an oxygen-sensitive liquid, using a rotary closing or capping machine comprising a rotatable rotor and a plurality of closing or capping devices disposed around a perimeter of said rotor, said method comprising the steps of:

forming an inert gas atmosphere in a chamber of said rotary closing or capping machine, which inert gas atmosphere comprises an inert gas which is essentially inert with respect to the oxygen-sensitive liquid, and which chamber being an annular chamber disposed around said perimeter of said rotor, which annular chamber comprising a plurality of wall elements essentially enclosing the entirety of an interior chamber space;

said step of forming an inert gas atmosphere in said chamber comprising flowing inert gas in a laminar flow;

rotating said rotor around its vertical machine axis, and thereby moving at least a top, circular, ring-shaped wall element, being connected to or forming part of said rotor, around said vertical machine axis;

positioning solely a mouth or mouth portion of each of the containers within said interior chamber space in said chamber and thus in said inert gas atmosphere, while positioning a body portion of each of the containers outside of said interior chamber space; and activating closing or capping devices of said rotary closing or capping machine and applying closures or caps to the mouths or mouth portions in said inert gas atmosphere in said chamber.

2. The method according to claim 1, wherein said step of forming an inert gas atmosphere in said chamber comprises conducting at least one of: $CO_2$, $CO_2$ gas, and nitrogen into said chamber, and forming said inert gas atmosphere which has an oxygen content less than 20%.

3. The method according to claim 1, wherein said method further comprises gassing, at least once, the portion of each container not containing an oxygen-sensitive liquid, by emitting a jet of an inert gas from a nozzle arrangement into the mouth of each container prior to capping or closing, which gassing is performed in said chamber in said inert gas atmosphere.

4. The method according to claim 1, wherein:

said method further comprises flowing an inert gas over the closures or caps during and/or before their installation on the containers;

said step of forming said inert gas atmosphere comprises forming said inert gas atmosphere which has an oxygen content less than 5%;

during closing or capping, flowing inert gas at least in the area of the mouths or mouth portions; and said method further comprises filling the containers in a normal atmosphere prior to closing or capping.

5. The method according to claim 1, wherein:

said wall elements comprise:

an upper wall disposed substantially perpendicular to said vertical machine axis;

a lower wall disposed opposite said upper wall and substantially perpendicular to said vertical machine axis;

an outer wall disposed transverse to said upper and lower walls; and an inner wall disposed opposite to said outer wall and transverse to said upper and lower walls, which inner wall is radially closer to said vertical machine axis than said outer wall and is surrounded by said outer wall;

at least one of said walls is mounted on said rotor to move with said rotor, and at least one other of said walls is not mounted on said rotor and is stationary with respect to said at least one of said walls mounted on said rotor; and said step of rotating said rotor comprises moving said at least one of said walls mounted on said rotor with respect to said at least one other of said walls not mounted on said rotor.

6. The method according to claim 5, wherein said step of forming an inert gas atmosphere in said chamber comprises conducting at least one of: $CO_2$, $CO_2$ gas, and nitrogen into said chamber, and forming said inert gas atmosphere which has an oxygen content less than 20%.

7. The method according to claim 6, wherein said method further comprises gassing, at least once, the portion of each container not containing an oxygen-sensitive liquid, by emitting a jet of an inert gas from a nozzle arrangement into the mouth of each container prior to capping or closing, which gassing is performed in said chamber in said inert gas atmosphere.

8. The method according to claim 7, wherein:

said method further comprises flowing an inert gas over the closures or caps during and/or before their installation on the containers;

said step of forming said inert gas atmosphere comprises forming said inert gas atmosphere which has an oxygen content less than 5%;

during closing or capping, flowing inert gas at least in the area of the mouths or mouth portions; and said method further comprises filling the containers in a normal atmosphere prior to closing or capping.

9. A rotary closing or capping machine for closing or capping containers comprising bottles, cans or similar containers containing an oxygen-sensitive liquid, said rotary closing or capping machine comprising:

a rotor being rotatable around a vertical machine axis;

a chamber to contain an inert gas, which is essentially inert with respect to an oxygen-sensitive liquid in containers to be closed or capped, in an amount sufficient to form an inert gas atmosphere therein;

said chamber being an annular chamber disposed around a perimeter of said rotor;

said chamber comprising a plurality of wall elements that essentially enclose the entirety of an interior chamber space;

at least a top, circular, ring-shaped wall element being connected to or forming part of said rotor and being movable by said rotor, and at least one other of said wall elements being separate from said rotor and being stationary with respect to said at least one of said wall elements movable by said rotor;

a plurality of container handling devices to position solely mouths or mouth portions of containers within said interior chamber space in said chamber and thus in the inert gas atmosphere, and position body portions of the containers outside of said interior chamber space; and a plurality of closing or capping stations to apply closures or caps to mouths or mouth portions of containers in the inert gas atmosphere in said chamber, which closing or capping stations are disposed around the perimeter of said rotor.

10. The rotary closing or capping machine according to claim 9, wherein:

each of said closing or capping stations comprises a closure or cap handling structure to handle closures or caps; and said closure or cap handling structures are disposed within said chamber.

11. The rotary closing or capping machine according to claim 9, wherein:

said container handling devices are disposed outside of said chamber; and said rotary closing or capping machine comprises connections to deliver inert gas into said chamber, and outlets to discharge inert gas out of said chamber.

12. The rotary closing or capping machine according to claim 9, wherein:

said rotary closing or capping machine comprises a perforated partition disposed in said chamber and to divide said chamber into two sub-chambers; and said perforated partition produces a laminar or essentially laminar inert gas flow in said chamber in a flow direction toward the mouths or mouth portions from the top to the bottom of said chamber or essentially from the top to the bottom of said chamber.

13. The rotary closing or capping machine according to claim 9, wherein:

said rotary closing or capping machine comprises at least one nozzle, disposed in said chamber, to emit a jet of an inert gas into each mouth in said inert gas atmosphere to gas, at least once, the portion of each container not containing an oxygen-sensitive liquid, prior to closing or capping; and said rotary closing or capping machine is in combination with a filling machine to fill containers under a normal atmosphere prior to closing or capping.

14. The rotary closing or capping machine according to claim 9, wherein:

said wall elements comprise:

an upper wall disposed substantially perpendicular to said vertical machine axis;

a lower wall disposed opposite said upper wall and substantially perpendicular to said vertical machine axis;

an outer wall disposed transverse to said upper and lower walls; and an inner wall disposed opposite to said outer wall and transverse to said upper and lower walls, which inner wall is radially closer to said vertical machine axis than said outer wall and is surrounded by said outer wall.

15. The rotary closing or capping machine according to claim 14, wherein:

said at least one of said walls mounted on said rotor comprises said inner wall and said lower wall;

said lower wall is in the shape of a disc that extends radially, with respect to said vertical machine axis, to a position adjacent a lower edge of said outer wall;

said outer wall extends from a perimeter edge of said upper wall to a perimeter edge of said lower wall;

each of said closing or capping stations comprises a closure or cap handling structure to handle closures or caps; and said closure or cap handling structures are disposed within said chamber.

16. The rotary closing or capping machine according to claim 15, wherein:

said container handling devices are disposed outside of said chamber; and said rotary closing or capping machine comprises connections to deliver inert gas into said chamber, and outlets to discharge inert gas out of said chamber.

17. The rotary closing or capping machine according to claim 16, wherein:

said rotary closing or capping machine comprises a perforated partition disposed in said chamber and to divide said chamber into two sub-chambers; and said perforated partition produces a laminar or essentially laminar inert gas flow in said chamber in a flow direction toward the mouths or mouth portions from the top to the bottom of said chamber or essentially from the top to the bottom of said chamber.

18. The rotary closing or capping machine according to claim 17, wherein:

said rotary closing or capping machine comprises at least one nozzle disposed in said chamber and to emit a jet of an inert gas into each mouth in said inert gas atmosphere to gas, at least once, the portion of each container not containing an oxygen-sensitive liquid, prior to closing or capping; and said rotary closing or capping machine is in combination with a filling machine to fill containers under a normal atmosphere prior to closing or capping.

* * * * *